US008948662B2

(12) United States Patent
Ochi et al.

(10) Patent No.: US 8,948,662 B2
(45) Date of Patent: Feb. 3, 2015

(54) TWO-COMPONENT DEVELOPER, DEVELOPING DEVICE, AND IMAGE FORMING APPARATUS

(71) Applicant: Fuji Xerox Co., Ltd., Tokyo (JP)

(72) Inventors: Takashi Ochi, Ebina (JP); Yasuaki Watanabe, Ebina (JP); Tomoyuki Yoshii, Ebina (JP); Jun Abe, Ebina (JP); Takayuki Yamashita, Ebina (JP); Toji Tokutsu, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 93 days.

(21) Appl. No.: 13/888,782

(22) Filed: May 7, 2013

(65) Prior Publication Data

US 2014/0086641 A1 Mar. 27, 2014

(30) Foreign Application Priority Data

Sep. 25, 2012 (JP) ..... 2012-210888

(51) Int. Cl.
*G03G 15/09* (2006.01)
*G03G 9/08* (2006.01)
*G03G 15/08* (2006.01)

(52) U.S. Cl.
CPC ..... *G03G 9/0821* (2013.01); *G03G 15/0805* (2013.01); *G03G 15/09* (2013.01)
USPC ..... 399/267; 399/270; 399/277

(58) Field of Classification Search
CPC . G03G 9/0821; G03G 15/0805; G03G 15/09; G03G 15/0907; G03G 15/0921; G03G 15/0928
USPC ..... 399/267, 270, 276, 277
See application file for complete search history.

(56) References Cited

U.S. PATENT DOCUMENTS 7,362,990 B2 * 4/2008 Itagaki et al. ..... 399/267
7,962,073 B2 * 6/2011 Kobayashi et al. ..... 399/270

FOREIGN PATENT DOCUMENTS

JP A-2006-178410 7/2006
JP A-2006-178412 7/2006

* cited by examiner

*Primary Examiner* — Hoang Ngo
(74) *Attorney, Agent, or Firm* — Oliff PLC

(57) ABSTRACT

A two-component developer includes toner and a magnetic carrier. The two-component developer is used in a developing device including a circular cylindrical developer transporting member that is disposed so as to be separated by 125 μm to 250 μm from a latent image carrier that rotates. The two-component developer is used so as to satisfy a condition in which a width of a region where a magnetic brush contacts a surface of the latent image carrier is in a range of from 1.0 mm to 2.25 mm, and a condition in which a developer density of the region where the magnetic brush contacts the surface of the latent image carrier is in a range of from $0.75\times10^{-6}$ to $1.50\times10^{-6}$ g/m$^3$.

3 Claims, 7 Drawing Sheets

| DRS [μm] | DEVELOPER DENSITY ($10^{-6}$ × g/m$^3$) | CONTACT WIDTH: K [mm] | | | | |
|---|---|---|---|---|---|---|
| | | 0.5 | 1.0 | 2.0 | 2.25 | 2.5 |
| 100 | 0.5 | | | | | |
| | 1.0 | | GOOD | GOOD | | GOOD |
| | 1.5 | | GOOD | GOOD | | GOOD |
| | 2.0 | | GOOD | GOOD | | GOOD |
| 125 | 1.5 | | GOOD | GOOD | GOOD | NOT GOOD |
| 150 | 0.5 | | | | | |
| | 0.75 | | GOOD | GOOD | GOOD | NOT GOOD |
| | 1.0 | | GOOD | GOOD | GOOD | NOT GOOD |
| | 1.5 | | GOOD | GOOD | GOOD | NOT GOOD |
| | 2.0 | | GOOD | GOOD | | |
| 250 | 0.5 | | | | | |
| | 0.75 | | GOOD | GOOD | GOOD | NOT GOOD |
| | 1.0 | | GOOD | GOOD | GOOD | NOT GOOD |
| | 1.25 | | GOOD | GOOD | GOOD | NOT GOOD |
| | 1.5 | | GOOD | GOOD | GOOD | NOT GOOD |
| | 2.0 | | | | | |
| 300 | 0.5 | | | | | |
| | 1.0 | | POOR | POOR | | POOR |
| | 1.5 | | POOR | POOR | POOR | POOR |
| | 2.0 | | POOR | POOR | POOR | POOR |

GOOD (REAR END ENHANCEMENT GRADE: LESS THAN G3)
NOT GOOD (REAR END ENHANCEMENT GRADE: G3 OR G4)
POOR (REAR END ENHANCEMENT GRADE: GREATER THAN OR EQUAL TO G5)

OCCURRENCE OF DEVELOPMENT UNEVENNESS (EVALUATION LEVEL: POOR)
REDUCTION IN DEVELOPABILITY (EVALUATION LEVEL: POOR)
REDUCTION IN DEVELOPABILITY (EVALUATION LEVEL: NOT GOOD)
OCCURRENCE OF DEVELOPER JAMMING (EVALUATION LEVEL: POOR)
OCCURRENCE OF DEVELOPER JAMMING (EVALUATION LEVEL: NOT GOOD)

FIG. 5

| DRS [μm] | DEVELOPER DENSITY ($10^{-6} \times g/m^3$) | CONTACT WIDTH: K [mm] | | | | |
|---|---|---|---|---|---|---|
| | | 0.5 | 1.0 | 2.0 | 2.25 | 2.5 |
| 100 | 0.5 | | | | | |
| | 1.0 | | GOOD | GOOD | | GOOD |
| | 1.5 | | GOOD | GOOD | | GOOD |
| | 2.0 | | GOOD | GOOD | | GOOD |
| 125 | 1.5 | | GOOD | GOOD | GOOD | NOT GOOD |
| 150 | 0.5 | | | | | |
| | 0.75 | | GOOD | GOOD | GOOD | NOT GOOD |
| | 1.0 | | GOOD | GOOD | GOOD | NOT GOOD |
| | 1.5 | | GOOD | GOOD | GOOD | NOT GOOD |
| | 2.0 | | GOOD | GOOD | | |
| 250 | 0.5 | | | | | |
| | 0.75 | | GOOD | GOOD | GOOD | NOT GOOD |
| | 1.0 | | GOOD | GOOD | GOOD | NOT GOOD |
| | 1.25 | | GOOD | GOOD | GOOD | NOT GOOD |
| | 1.5 | | GOOD | GOOD | GOOD | NOT GOOD |
| | 2.0 | | | | | |
| 300 | 0.5 | | | | | |
| | 1.0 | | POOR | POOR | | POOR |
| | 1.5 | | POOR | POOR | POOR | POOR |
| | 2.0 | | POOR | POOR | POOR | POOR |

GOOD (REAR END ENHANCEMENT GRADE: LESS THAN G3)
NOT GOOD (REAR END ENHANCEMENT GRADE: G3 OR G4)
POOR (REAR END ENHANCEMENT GRADE: GREATER THAN OR EQUAL TO G5)

OCCURRENCE OF DEVELOPMENT UNEVENNESS (EVALUATION LEVEL: POOR)
REDUCTION IN DEVELOPABILITY (EVALUATION LEVEL: POOR)
REDUCTION IN DEVELOPABILITY (EVALUATION LEVEL: NOT GOOD)
OCCURRENCE OF DEVELOPER JAMMING (EVALUATION LEVEL: POOR)
OCCURRENCE OF DEVELOPER JAMMING (EVALUATION LEVEL: NOT GOOD)

(DRS → LARGE)

(DRS → SMALL)

TWO-COMPONENT DEVELOPER, DEVELOPING DEVICE, AND IMAGE FORMING APPARATUS

CROSS-REFERENCE TO RELATED APPLICATIONS

This application is based on and claims priority under 35 USC 119 from Japanese Patent Application No. 2012-210888 filed Sep. 25, 2012.

BACKGROUND (i) Technical Field

The present invention relates to a two-component developer, a developing device, and an image forming apparatus.

(ii) Related Art

Image forming apparatuses (such as printers, copying machines, and facsimiles) to which an image recording system such as an electrostatic recording system or an electrophotographic system is applied includes a developing device that develops an electrostatic latent image, which is formed on a latent image carrier (such as a photoconductor member) that rotates, using developer.

SUMMARY

According to an aspect of the invention, there is provided a two-component developer including toner and a magnetic carrier. The two-component developer is used in a developing device including a circular cylindrical developer transporting member that is disposed so as to be separated by 125 μm to 250 μm from a latent image carrier that rotates. The developer transporting member rotates so that a direction of movement of a portion thereof that approaches the latent image carrier is in an opposite direction. The two-component developer is carried and transported by the developer transporting member of the developing device while a magnetic brush is formed. The two-component developer is used so as to satisfy a condition in which a width of a region where the magnetic brush contacts a surface of the latent image carrier is in a range of from 1.0 mm to 2.25 mm, and a condition in which a developer density of the region where the magnetic brush contacts the surface of the latent image carrier is in a range of from $0.75\times10^{-6}$ to $1.50\times10^{-6}$ g/m$^3$.

BRIEF DESCRIPTION OF THE DRAWINGS

An exemplary embodiment of the present invention will be described in detail based on the following figures, wherein:

FIG. 5 is a table of the results of a test in which states of occurrences of rear end enhancement of an image are examined;

DETAILED DESCRIPTION

An exemplary embodiment of the invention is hereunder described with reference to the drawings.

Exemplary Embodiment

Figure 1:
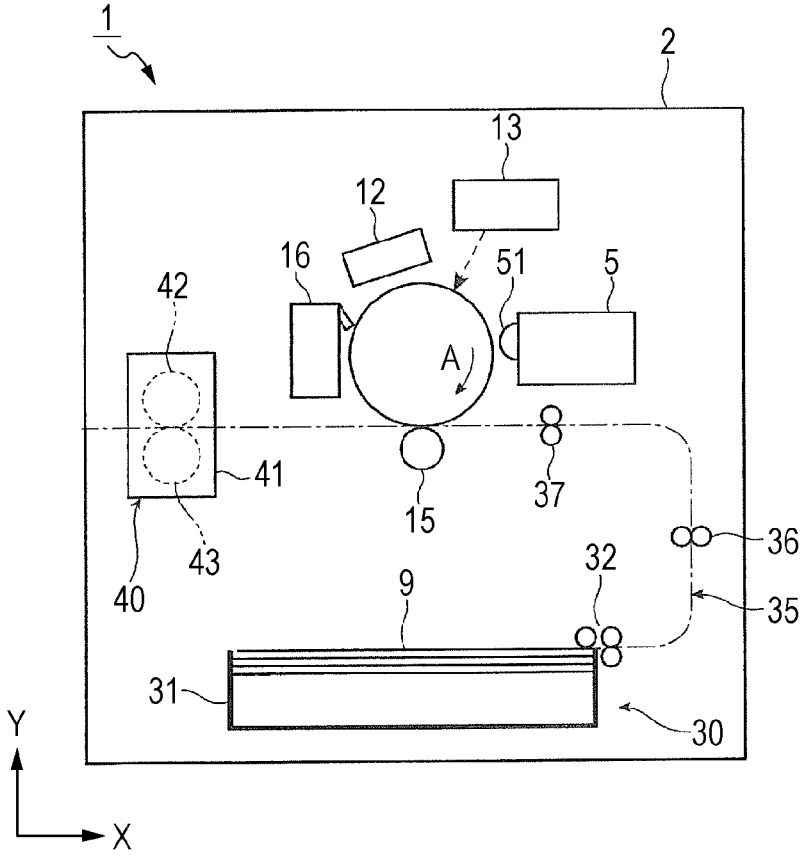
FIG. 1 illustrates a principal portion of an image forming apparatus using a developing device according to an exemplary embodiment.
Figure 2:
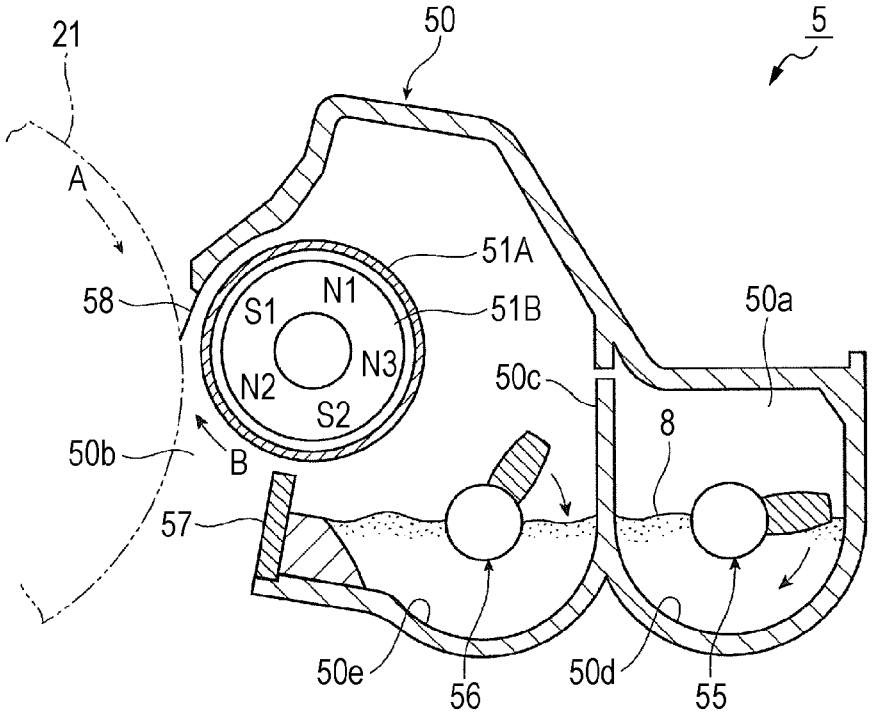
FIG. 2 is a schematic sectional view of the developing device that is used in the image forming apparatus shown in FIG. 1.

FIGS. 1 and 2 each illustrate an image forming apparatus 1 to which a developing device 5 according to an exemplary embodiment is applied. FIG. 1 schematically illustrates the image forming apparatus 1. FIG. 2 schematically illustrates the developing device 5.

As shown in FIG. 1, the image forming apparatus 1 includes an image forming device 10, a sheet feeding device 30, and a fixing device 40, which are disposed in an internal space of a housing 2 (formed of, for example, a supporting member and an external member). The image forming device 10 forms a toner image using developer, and transfers the toner image to a sheet 9. The sheet feeding device 30 contains sheets 9 to be supplied to the image forming device 10, and sends out the sheets 9. The fixing device 40 fixes the toner image that has been transferred at the image forming device 10 to the sheet 9. An alternate long and short dash line in FIG. 1 indicates a principal sheet transport path along which a sheet 9 is transported in the housing 2.

The image forming device 10 is formed by using, for example, an electrophotographic system that is publicly known. The image forming device 10 primarily includes a photoconductor drum 11, a charging device 12, an exposure device 13, the developing device 5, a transfer device 15, and a cleaning device 16. The photoconductor drum 11 is rotationally driven in the direction of arrow A (that is, clockwise in FIG. 1). The charging device 12 charges the peripheral surface of the photoconductor drum 11 to a required potential. The exposure device 13 irradiates the charged peripheral surface of the photoconductor drum 11 with light that is based on image information (signal), and forms an electrostatic latent image having a potential difference. The developing device 5 forms the electrostatic latent image into a toner image by developing the electrostatic latent image with toner of a two-component developer 8. The transfer device 15 transfers the toner image to the sheet 9. The cleaning device 16 removes, for example, residual toner on the peripheral surface of the photoconductor drum 11 after the transfer, and cleans the peripheral surface of the photoconductor drum 11.

The photoconductor drum 11 is, for example, one that includes a photosensitive layer (formed of, for example, an organic photosensitive material) provided along an outer peripheral surface of a circular cylindrical conductive base that is connected to ground. The charging device 12 is a contact or a non-contact charging device. As the exposure device 13, a laser beam scanning device in which a semiconductor layer and various optical components are combined or a light emitting diode (LED) array in which light-emitting diodes (LEDs) and various optical components are combined is used. The exposure device 13 irradiates the photoconductor drum 11 with light that is based on an image signal that is obtained by performing a required processing operation on image information using an image processing device (not shown). The image information is input from an image generating source (such as a document reading device, an external connecting device, or a storage medium reading device) that, is connected to or provided at the image forming apparatus 1.

The developing device 5 is one that uses the two-component developer 8 containing nonmagnetic toner and magnetic carriers (particles). As shown in, for example, FIG. 2, the developing device 5 includes a developing roller 51 that uses what is called a contact counter development system. In the contact counter development system, the developing roller 51 performs development by carrying the two-component developer 8 in the form of a magnetic brush and causing it to contact the peripheral surface of the photoconductor drum 11 (that is, a portion of the photoconductor drum 11 where an electrostatic latent image is formed). The developing roller 51 rotates so that a direction of movement of a portion of the developing roller 51 that approaches the photoconductor drum 11 is in the opposite direction (that is, the direction of arrow B). The developing device 5 is described in detail below.

The transfer device 15 is a contact or a non-contact transfer device. The cleaning device 16 is, for example, one in which a cleaning blade and a rotating brush that contact the peripheral surface of the photoconductor drum 11 are caused to contact the peripheral surface of the photoconductor drum 11. When an image is to be formed (image formation operation is to be executed), a charging voltage, a development voltage, and a transfer voltage are applied to the charging device 12, (the developing roller 51) of the developing device 5, and the transfer device 15, respectively.

The sheet feeding device 30 includes a sheet container 31 and a sending-out unit 32. The sheet container 31 contains stacked sheets 9 that are of, for example, required sizes and types and that are used for forming an image. The sending-out unit 32 sends out the sheets 9, which are contained in the sheet container 31, one at a time towards the sheet transport path. The sheet container 31 is mounted so that it is capable of being drawn out from the housing 2 when, for example, replenishing the sheet container 31 with sheets 9. More than one sheet container 31 is provided depending upon the mode of use. A sheet feed path 35 is provided between the sheet feeding device 30 and a transfer position of the image forming device 10 (that is, between the photoconductor drum 11 and the transfer device 15). The sheet feed path 35 is defined by, for example, pairs of transport rollers 36 and 37 and a transport guide member. When it is time to perform an image formation operation, the sheet feeding device 30 sends out required sheets 9 one at a time to the sheet feed path 35.

The fixing device 40 includes a rotationally driven heating rotating member 42 and a pressing rotating member 43 in the housing 41. The heating rotating member 42 is in the form of, for example, a roller or a belt. The surface temperature of the heating rotating member 42 is increased to and maintained at a required temperature by a heating unit. The pressing rotating member 43 is in the form of, for example, a driven rotating roller or belt. The pressing rotating member 43 contacts with a required pressure the heating rotating member 42 substantially along an axial direction thereof, and is driven and rotated. The fixing device 40 fixes an unfixed toner image to a sheet 9 by causing the sheet 9 to which the unfixed image has been transferred to pass a contact portion (that is, a fixing processing portion) between the heating rotating member 42 and the pressing rotating member 43, and by fusing the unfixed toner image under pressure.

The image forming apparatus 1 forms an image as follows. Here, the method of forming an image is described taking as an example a basic image formation operation that is performed when an image is formed on one surface of a sheet 9.

When the image forming apparatus 1 receives an instruction to start image formation, in the image forming device 10 of the image forming apparatus 1, the outer peripheral surface of the photoconductor drum 11 that starts to rotate in the direction of arrow A is charged to a predetermined polarity and potential by the charging device 12. Then, the exposure device 13 performs exposure on the charged peripheral surface of the photoconductor drum 11 to form an electrostatic latent image having a required potential difference. The exposure is based on image information. Next, when the electrostatic latent image that is formed on the photoconductor drum 11 passes the developing device 5, the electrostatic latent image is developed using toner of the two-component developer 8 supplied from the developing roller 50, and is made visible as a toner image.

Next, when the toner image that is formed on the photoconductor drum 11 is transported by the rotation of the photoconductor drum 11 to the transfer position that opposes the transfer device 15, the transfer device 15 transfers the toner image to the sheet 9 that is supplied from the sheet feeding device 30 via the sheet feed path 35 in accordance with the timing in which the toner image is transported to the transfer position. The peripheral surface of the photoconductor drum 11 after the transfer is cleaned by the cleaning device 16.

Next, the sheet 9 to which the toner image has been transferred is separated from the photoconductor drum 11, is transported so as to enter the fixing processing portion of the fixing device 40, and is subjected to a fixing operation (heating and pressing operation), so that the toner image is fixed. The sheet 9 after the fixing operation is completed is discharged from the fixing device 40, and is held by, for example, a discharge holding section (not shown) that is provided at, for example, an outer portion of the housing 2.

By the above-described operations, a monochromatic image formed of toner of one color is formed on one surface of one sheet 9, and the basic image formation operation ends. When there is a request to form images on multiple sheets, the above-described operations are similarly repeated for the required number of sheets.

Next, the developing device 5 is described in detail.

As shown, in, for example, FIG. 2, the developing device 5 includes a body 50 including a chamber 50*a* and a rectangular opening 50*b*. The chamber 50*a* contains the aforementioned two-component developer 8. The opening 50*b* is formed at a position that faces the photoconductor drum 11. The body 50 is an elongated container having a length that is greater than the length of the photoconductor drum 11 in an axial direction thereof. Two developer circulating transport paths (grooved portions) 50*a* and 50*e* are formed parallel to each other at the bottom portion of the chamber 50*a*. The developer circulating transport paths 50*d* and 50*e* are connected to each other at both ends of elongated container shapes of the developer circulating transport paths 50*d* and 50*e* in a longitudinal direction thereof, and are divided from each other by a central partition wall along the longitudinal direction. The two-component developer 8 is contained in the container 50*a*.

The developing device 5 includes, for example, the developing roller 51, two screw augers 55 and 56, and a regulating plate 57, which are disposed in the body 50. The developing roller 51 carries and transports the two-component developer 8 up to a development area that opposes the photoconductor drum 11 with magnetic force. The screw augers 55 and 56 serve as stirring transporting members that stir and transport the two-component developer 8 that is contained in the chamber 50*a*. The regulating plate 57 regulates the passage of the two-component developer 8 that is supplied to the developing roller 51 from the screw auger 56, and regulates the thickness (transport amount) of a layer of the two-component developer 8. Reference numeral 58 in FIG. 2 denotes a leakage prevention film that prevents leakage of the developer 8 from a gap between the photoconductor drum 11 and the opening 50*b* in the body.

The developing roller 51 includes a circular cylindrical sleeve 51A and a magnet roller 51B. The sleeve 51A is disposed so as to rotate in the direction of arrow B while a portion thereof is exposed to the opening 50*b* of the body 50. The magnet roller 51B is provided so as to exist while being fixed to the inner side of the sleeve 51A.

Using a nonmagnetic material (such as stainless steel or aluminum), the sleeve 51A is formed so as to include a circular cylindrical portion having a width (length) that is substantially equal to that of an effective image formation area of the photoconductor drum 11 in the direction of a rotation axis. The sleeve 51A is disposed so as to oppose the photoconductor drum 11 with the direction of a rotation axis thereof being substantially parallel to the direction of the rotation axis of the photoconductor drum 11. In addition, the sleeve 51A is disposed so that a gap between it and the photoconductor drum 11 (gap between the photoconductor drum and the developing roller (DRS)) is within a required range. End portions (serving as shaft portions) of the sleeve 51A are actually mounted to corresponding side portions of the body while the end portions are rotatably supported. The sleeve 51A is subjected to power from a rotationally driving device (not shown) through the shaft portions, so that the sleeve 50A is rotated at the shaft portions in the direction of arrow B. Further, a development voltage for forming a development electric field between the sleeve 51A and the photoconductor drum 11 is supplied to the sleeve 51A from a power supplying device (not shown). As the development voltage, for example, a direct current voltage on which an alternating-current component is superimposed is supplied.

The magnet roller 51B includes magnetic poles (S poles and N poles) that generate, for example, magnetic lines of force that cause the two-component developer 8 to be carried while magnetic carriers of the two-component developer 8 adhere to toner and a magnetic brush is formed (so as to stand in the form of a chain) at the outer peripheral surface of the sleeve 51A. For example, the magnet roller 51B is mounted while end portions thereof are secured to the side portions of the body 50 via an internal space at the shaft portions of the sleeve 51A. The magnetic poles extend along an axial direction of the sleeve 51A, and are disposed, at required positions so as to be spaced apart from each other in a peripheral direction (direction of rotation) of the sleeve 51A.

Figure 3:
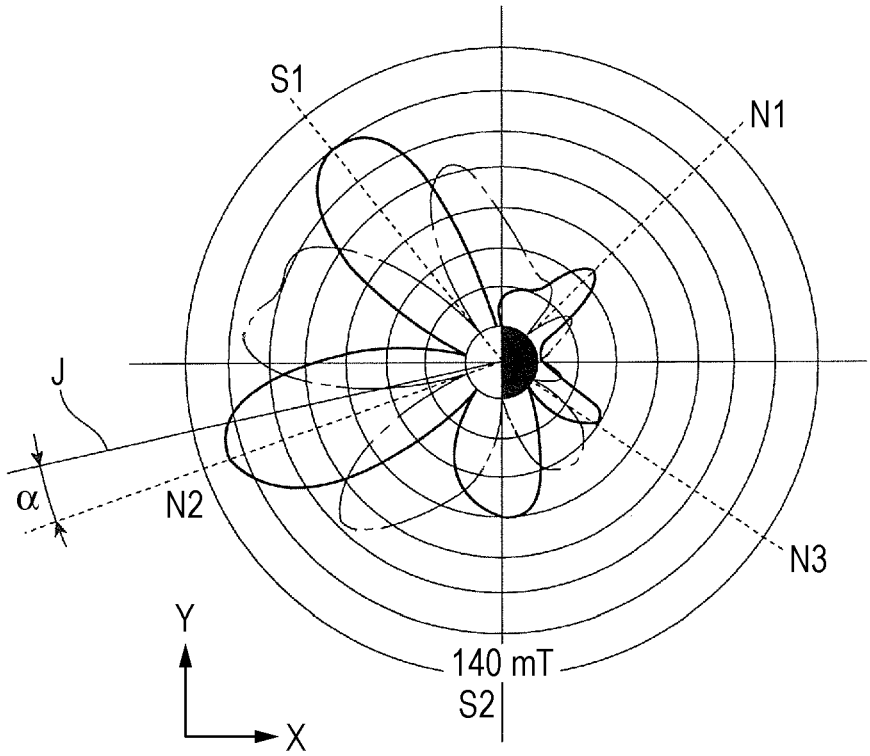
FIG. 3 illustrates magnetic poles of a magnet roller of a developing roller and magnetic flux density distribution in the developing device shown in FIG. 2.

As shown in FIG. 3, five magnetic poles, that is, S2, N2, S1, N1, and N3 are disposed in the magnet roller 51B. Of the magnetic poles, the magnetic pole S2 is a pickup pole that is disposed so as to substantially oppose the regulating plate 57, and that, using magnetic force, causes the two-component developer 8 that is supplied from the screw auger 56 (that is near the developing roller 51) to be pulled towards and carried by the outer peripheral surface of the sleeve 52A. The magnetic pole N2 is a principal development pole that is disposed so as to substantially oppose a development area of the photoconductor drum 11, and that causes the two-component developer 8 to contribute to a development process. The magnetic pole S1 is a transport pole. The magnetic poles N1 and N3 are pick-off poles that cause the two-component developer 8 to be separated from the outer peripheral surface of the sleeve 51A.

In FIG. 3, a thick solid line indicates a magnetic flux density distribution of a vertical component, and an alternate long and short dash line indicates a magnetic flux density distribution of a horizontal component. Concentric circles in FIG. 3 are circles that indicate 20 mT ranges of magnetic flux densities that gradually increase from, the center towards the outer side, symbol $\alpha$ in FIG. 3 denotes a set angle (MAS) by which the principal development pole N2 is set from a reference line J that connects the center of the developing roller 51 and the center of the photoconductor drum 11. When the set angle $\alpha$ is an angle that is at an upstream side of the sleeve 51A in the rotation direction of arrow B with reference to the reference line J, "+" is added to $\alpha$. In contrast, when the set angle $\alpha$ is an angle that is at a downstream side of the sleeve 51A in the rotation direction of arrow B with reference to the reference line J, "−" is added to $\alpha$.

As shown in FIG. 2, the screw augers 55 and 56 are each of a type in which a transport vane is spirally wound around a peripheral surface of a rotary shaft. The screw augers 55 and 56 are rotatably disposed in the developer circulating transport paths 50*d* and 50*e* in the chamber 50*a* of the body, respectively. The screw augers 55 and 56 are rotationally driven in directions in which the portions of the two-component developer 8 that are in the transport paths 50*d* and 50*e* are to be transported in required directions. The screw augers 55 and 56 are formed so as to rotate when a portion of the power of the rotationally driving device that rotates the sleeve 51A of the developing roller 51 is divided and is transmitted to the augers 55 and 56. The screw auger 56 that is disposed near the developing roller 51 is such that a portion of the developer 8 that the screw auger 56 transports is transferred and supplied to the developing roller 51.

As shown in FIG. 2, the regulating plate 57 is a rectangular plate member whose principal portion has a substantially constant thickness and a length that is at least equal to the length of the sleeve 51A of the developing roller 51 in the axial direction thereof (long side). The regulating plate 57 is formed of a nonmagnetic material (such as stainless steel). Further, the regulating plate 57 is in a state in which its end portion in a longitudinal direction thereof (long side portion below the sleeve 51A) faces the outer peripheral surface of the sleeve 51A so as to be spaced therefrom by a required interval (regulation interval). In addition, the regulating plate 57 is mounted to the body 50 so as to extend along the axial direction of the sleeve 51A and face the body 50.

As mentioned above, the two-component developer 8 used in the developing device 5 includes nonmagnetic toner and magnetic carriers.

The nonmagnetic toner includes toner particles and an external additive. The toner particles include a publicly known binding resin, a publicly known coloring agent, and another additive, such as a separating agent, as required. The external additive is caused to adhere to the surfaces of the toner particles for providing additionally required functions.

As the binding resin, for example, polyester resin or acrylic resin may be used. Other additives include, for example, a separating agent, a magnetic material, a charge controlling agent, and nonorganic power. As the external additive, a material that is capable of reducing adhesive force with respect to the photoconductor drum 11 for increasing toner transferability (for example, inorganic particles such as silica particles) is used. Although the method of producing toner particles is not particularly limited, it is possible to use, for example, a publicly known emulsion polymerization and coagulation method. The nonmagnetic toner is produced by mixing the toner particles and the external additive using, for example, a Henschel mixer or a V blender. The volume mean particle diameter of the nonmagnetic toner is desirably not less than 2.0 μm and not more than 8.0 μm.

As the magnetic carriers, for example, carriers formed of a magnetic material, covered carriers, magnetic powder dispersed carriers, or resin impregnated carriers may be used, in the covered carriers, a surface of a core, formed of magnetic powder, is covered with covering resin. In the magnetic powder dispersed carriers, magnetic powder is dispersed/mixed in matrix resin. In the resin impregnated carriers, porous magnetic powder is impregnated with resin. Examples of magnetic powder include magnetic metallic powder (such as iron oxide, nickel, and cobalt powder), and magnetic oxide powder (such as ferrite and magnetite powder). Examples of covering resin and matrix resin include polyethylene, polypropylene, and polystyrene. The volume mean particle diameter of the carriers is desirably, for example, not less than 15 μm and not more than 50 μm.

The two-component developer 8 is used by mixing the nonmagnetic toner with the magnetic carriers in a required content proportion. In addition, the two-component developer 8 is used so that the developing device 5 satisfies required conditions (described later).

The operation of the developing device 5 is described below.

First, when it is time for the image forming apparatus 1 to perform an image formation operation, the sleeve 51A of the developing roller 51 starts rotating, and a development voltage is applied to the sleeve 51A.

As a result, the two-component developer 8 that is contained in the chamber 50*a* of the body 50 is transported in various directions in the circulating transport paths 50*d* and 50*e* in the chamber 50*a* while being stirred by the augers 55 and 56 that rotate, so that the two-component developer 8 is transported while being circulated as a whole. Here, nonmagnetic toner 81 in the two-component developer 8 is sufficiently stirred with magnetic carriers 82, is frictionally charged to a required charge amount, and is set in a state in which the nonmagnetic toner 81 is electrostatically stuck on the surfaces of the carriers 82.

Next, the two-component developer 8 that is transported by the screw auger 56 (disposed near the developing roller 51) is such that a portion thereof is attracted and carried by the outer peripheral surface of the sleeve 51A of the developing roller 51 by magnetic force. That is, when magnetic force that is generated from the magnetic pole S2 of the magnet roller 51B acts upon the outer peripheral surface of the sleeve 51A that rotates, this portion of the two-component developer 8 is carried by the outer peripheral surface of the sleeve 51A while magnetic brushes 80 (in which the magnetic carriers to which the nonmagnetic toner adheres stand in the form of a chain) are formed. In the carried state, this portion of the two-component developer 8 is supplied. Thereafter, this portion of the two-component developer 8 that is carried by the sleeve 51A of the developing roller 51 is transported to a portion of the sleeve 51A that the regulating plate 57 opposes, and is regulated to a substantially constant layer thickness (transport amount) when this portion of the two-component developer 8 passes through a gap between the regulating plate 57 and the sleeve 51A.

Next, the two-component developer 8 that has been regulated by the regulating plate 57 is subjected to magnetic force of the development magnetic pole N2 and the action of a development electric field generated by a development voltage when the two-component developer 8 is transported by the sleeve 51A that rotates in the direction of arrow B, and contacts and passes the development area that opposes the photoconductor drum 11. This causes the toner of the magnetic brushes of the two-component developer 8 to move to the peripheral surface of the photoconductor drum 11, and adhere to a latent image portion that passes the development area, so that the latent image portion is developed.

Next, the two-component developer 8 that has passed the development area is transported by the sleeve 51A by magnetic force of the transport pole S1, after which the two-component developer 8 is separated from the outer peripheral surface of the sleeve 51A when the two-component developer 8 passes between the magnetic poles (separation poles) N1 and N3, and eventually returns to the chamber 50*a*.

The developing device 5 uses a contact counter development system that uses the two-component developer 8. Therefore, as exemplified in FIG. 11, image quality defect (hereunder simply referred to as "rear end enhancement") tends to occur. In such an image quality defect, the density of a rear end portion (upstream end portion in the rotation direction A of the photoconductor arum 11) of an image (that is, a toner image formed by developing a latent image portion using toner) is increased due to a relative increase in the toner amount.

The inventor et al. studied the causes (mechanisms) of the occurrence of such rear end enhancement by, for example, observation and simulation. The principal causes are sweeping of toner by a magnetic brush and excessive development caused by fringe electric field (diffraction electric field).

Figure 11:
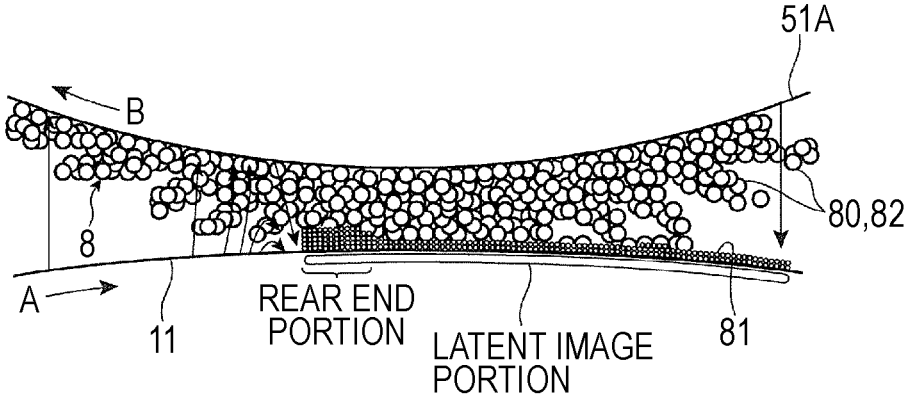
FIG. 11 illustrates in enlarged form the state of increase of the density of the rear end of an image occurring in a contact counter development system.

That is, as exemplified in FIG. 11, in the contact counter development system, the relative speed between the photoconductor drum 11 and the sleeve 51A is high. Therefore, the magnetic brushes 80 of the two-component developer 8 on the sleeve 51A rub the electrostatic latent image on the photoconductor drum 11 a large number of times. Therefore, the toner 81 that has developed the latent image portion on the photoconductor drum 11 by adhering thereto is rubbed by a following magnetic brush 80, as a result of which the toner 81 is swept towards the rear end of the latent image portion. A fringe electric field that diffracts around the rear end portion of the image (latent image) is generated. Therefore, the amount of toner that adheres to the rear end portion of the image is relatively increased, as a result of which excessive development is performed. Incidentally, when the sweeping of the toner by the magnetic brush occurs, the influence of the fringe electric field tends to be considerable. In FIG. 11, the arrow that is shown between the photoconductor drum 11 and the sleeve 51A indicates the state of a portion of an electric field (electromagnetic lines of force).

Accordingly, in the developing device 5 and by extension the image forming apparatus 1, in order to suppress rear end enhancement, which tends to occur in the contact counter development system, without using a new specific material, the following structure is used from the viewpoint that mitigating or eliminating the causes believed to give rise to the occurrence of rear end enhancement (that is, sweeping of toner caused by magnetic brushes and excessive development caused by fringe electric field) is important.

Figure 4:
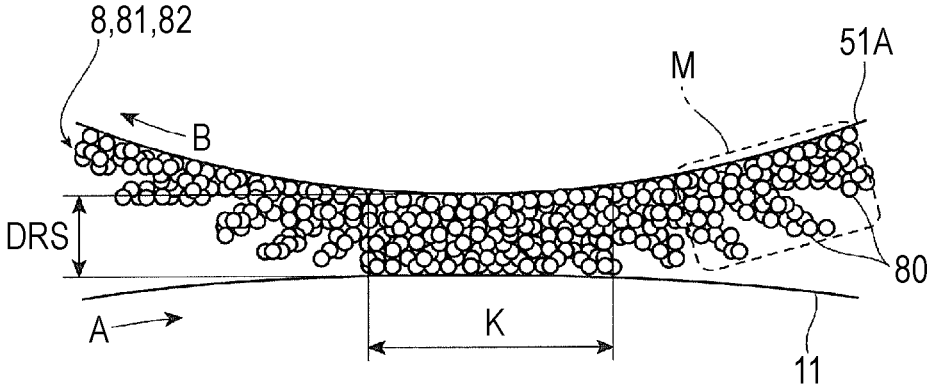
FIG. 4 illustrates in enlarged form characteristic factors (such as a gap and the width of a contact region) of the developing device shown in FIG. 2.

That is, in the developing device 5 and by extension the image forming apparatus 1, as shown in, for example, FIG. 4, the distance (DRS) between the developing roller 51 (that is, the sleeve 51A) and the peripheral surface of the photoconductor drum 11 is in the range of from 125 to 250 μm. In addition, a width (K) of a region that is formed when a magnetic brush of the two-component developer 8 on the developing roller 51 contacts the peripheral surface of the photoconductor drum 11 is in the range of from 1.0 to 2.25 mm. Further, a developer density (D) at the region (K) that is formed when a magnetic brush of the two-component developer 8 on the developing roller 51 contacts the peripheral surface of the photoconductor drum 11 is in the range of from $0.75\times10^{-6}$ to $1.50\times10^{-6}$ g/m$^3$.

The numerical ranges of the distance (DRS), the region width (K), and the developer density (D) are substantially derived from the results obtained by a test for confirming the states of occurrences of rear end enhancement that is described in detail below. Among the numerical value ranges, the numerical value range of the region width (K) is measured by, for example, an electrostatic adhesion method. More specifically, the region width (K) is determined by averaging numerical values of actually measured widths of a portion where the magnetic brush 80 of the two-component developer 8 that is formed on the developing roller 51 from an internal portion of a circular cylindrical member formed of transparent glass contacts the peripheral surface of the circular cylindrical member (lengths along the rotation direction of arrow A of the photoconductor drum 11). The circular cylindrical member has the same diameter as the photoconductor drum 11 and is set in place of the photoconductor drum 11. The developer density (D) (g/m$^3$) is a value that is obtained by dividing the amount (transport amount) M (g/m$^2$) of the two-component developer 8 that is carried and transported per unit area of the sleeve 51A by the distance (DRS) between the sleeve 51A and the photoconductor drum 11 (that is, P=M/DRS). The transport amount M is calculated by using a value that is obtained by measuring the mass of developer that exists in a predetermined unit area while the sleeve 51A is stopped and that is separated from the peripheral surface of the sleeve 51A.

Test

In the test, as the developing device 5, developing devices including the following developing roller 51 is used. The developing devices having different combinations of values of the distance (DRS), the region width (K), and the developer density (D) shown in FIG. 5 are used. The developing roller 51 includes a nonmagnetic sleeve 51A whose circular cylindrical portion has an outside diameter of 20 mm, and a magnet roller 51B in which the above-described five magnetic poles (S2, N2, S1, N1, and N3) are disposed. The surface of the sleeve 51A is treated by forming thin grooves (having a depth of 100 μm) that extend linearly along a rotation axis direction with a pitch of 400 μm. MSA of the development pole N2 of the magnet roller 51B is +5 degrees.

The two-component developer 8 used in each developing device 5 is one including nonmagnetic toner (whose volume mean particle diameter is 5.8 μm and specific gravity is 1.1) and magnetic carriers such as ferrite carriers (whose volume mean particle diameter is 35 μm, specific gravity is 4.8, and magnetization is 58 emu/sec). The nonmagnetic toner includes toner particles and an external additive, such as a silicon compound, a zinc compound, or an organic compound. The toner particles are manufactured by an emulsion polymerization and coagulation method using polyester resin as binding resin. The toner content proportion is 9.0%, and the charge amount (Q/m) is 40 μC/g. The transport amount M of the two-component developer 8 on the developing roller 51 (sleeve 51A) is 225 g/m$^2$.

As the photoconductor drum 11, a photoconductor drum having a structure including, for example, a photosensitive layer formed of an organic photosensitive material and formed on the peripheral surface of a circular cylindrical conductive base (the outside diameter of the photoconductor drum is 30 mm) is used. The rotation velocity (peripheral velocity) of the photoconductor drum 1 is 350 mm/sec. In contrast, the developing roller 51 (that is, the sleeve 51A) is rotated so that the peripheral velocity ratio is 1.75. The relative velocity between the developing roller 51 and the photoconductor drum 11 at this time is 963 mm/sec.

In the test, the formation of a test image in each of the image forming apparatuses 1 including the corresponding developing device 5 (including the two-component developer 8) and the above-described photoconductor drum 11 is similarly carried out, and the state of occurrence of rear end enhancement in each test image that is obtained at this time is examined. The test images are formed as follows. After charging the photoconductor drum 11 to −800 V, electrostatic latent images of patch images serving as the test images are formed. The patch images are rectangular images of five types having corresponding image area ratios of 10%, 30%, 50%, 80%, and 100% with a size of 15 mm (width)×15 mm (length). The electrostatic latent images are such that their screen dot latent image potential is −400 V. Then, the two-component developer 8 is supplied using the developing roller 51 to which a development voltage of −650 V is applied in the developing device 5 that is formed under each of the aforementioned corresponding conditions, so that contact counter development is performed. Thereafter, final images obtained by transferring and fixing the developed test patch images to a sheet 9 are observed, to check the states of occurrences of rear end enhancements of the corresponding patch images. The results at this time are evaluated on the basis of the following criteria. Of the evaluation results of the patch images having the aforementioned five types of image area ratios, the worst evaluation results of the patch images obtained from sensory evaluation (that is, visual observation of rear end enhancement) are used as evaluation results.

Evaluation Criteria of States of Occurrences of Rear End Enhancement

Good: When rear end enhancement grade is less than G3 (that is, at least half of the eleven evaluators think that, practically speaking, there is no problem in rear end enhancement in terms of image quality level)

Not good: When rear end enhancement grade is G3 or G4 (that is, less than half of the eleven evaluators think that, practically speaking, there is no problem in rear end enhancement grade in terms of image quality level)

Poor: When rear end enhancement grade is greater than or equal to G5 (up to G6) (that is, none of the evaluators think that, practically speaking, there is no problem in rear end enhancement grade in terms of image quality level)

Rear End Enhancement Grade

G1: No rear end enhancement

G2: Rear end enhancement is seen for the first time when a person looks carefully at a rear end portion G3: Rear end enhancement is seen slightly, but does not bother a person so much G4: Rear end enhancement is seen, and slightly bothers a person G5: Rear end enhancement is conspicuous, and portion where rear end enhancement occurs stands out G6: Due to rear end enhancement, it seems that image with rear end enhancement is not a proper image The evaluation results at this time are shown in FIG. 5. In FIG. 5, the portions where "good", "not good", or "poor" is not indicated are portions where evaluations of the states of occurrences of rear end enhancement are not properly performed due to the occurrence of other problematic development operations. The other problematic development operations are generally as shown in FIG. 5.

Here, problematic development operations regarding development unevenness are developments in which density unevenness caused by development unevenness in patch images obtained in the test occurs. In this case, it may be difficult to determine the state of occurrence of rear end enhancement due to the existence of the development unevenness. The development unevenness is evaluated by an additional test in which 50 mm×50 mm halftone images (image area ratio=50%) are developed under the same condition as that of the test. The result of the additional test is "poor" since at least half of the evaluators think that the image level is practically unallowable. In the test of confirming the development unevenness, the result is never "not good" where less than half of the evaluators think that the image level is practically allowable.

Problematic development operations regarding developability are developments in which thin images are formed because the densities of entire patch images obtained in the test do not reach a target density. In this case, it is difficult to determine the state of occurrence of rear end enhancement because the image density is low. The developability is evaluated by an additional test that changes only development voltage under the same condition as that of the test. At this time, the evaluation result is "poor", when the case in which the image density does not reach the target density even when the development is performed with the development voltage being changed to a value that is at least 50 V greater than −400 V (which is the development voltage at the time of the test), that is, with the development electric field being changed to a value that is greater than or equal to 600 V is considered an unallowable level. The evaluation result is "not good", when the case in which the target density is reached when development is performed with the latent image voltage being changed to a value within the range of from −150 V to −50 V, that is, with the development electric field being changed to a value within the range of from 500 V to 600 V is considered as a slightly allowable level.

Further, problematic development operations regarding developer jamming are developments in which the two-component developer 8 accumulates and is jammed in the gap between the developing roller 51 and the photoconductor drum 11 (gap that is set at each DRS). In this case, since the development is no longer properly carried out due to the developer jamming, it is difficult to determine the state of occurrence of rear end enhancement. Regarding the developer jamming, the level at which the two-component developer 8 is jammed in the gap and a portion of the developer flows out from the gap corresponds to the evaluation result "poor", and the level at which the developer is jammed in the gap but does not flow out corresponds to the evaluation result "not good".

From the results shown in FIG. 5, it is possible to suppress the occurrence of rear end enhancement (to achieve the evaluation result "good") when the distance (DRS) between the developing roller 51 and the photoconductor drum 11 is in the range of from 125 to 250 μm, the width (K) of the region where a magnetic brush contacts the photoconductor drum 11 is in the range of from 1.0 to 2.25 mm, and the developer density at the region where a magnetic brush contacts the photoconductor drum 11 is in the range of from $0.75\times10^{-6}$ to $1.50\times10^{-6}$ g/m$^3$.

The results in FIG. 5 are described in detail.

First, when the distance (DRS) between the developing roller 51 and the photoconductor drum 11 is less than or equal to 250 μm, the occurrence of rear end enhancement may tend to be suppressed.

Figure 6A:
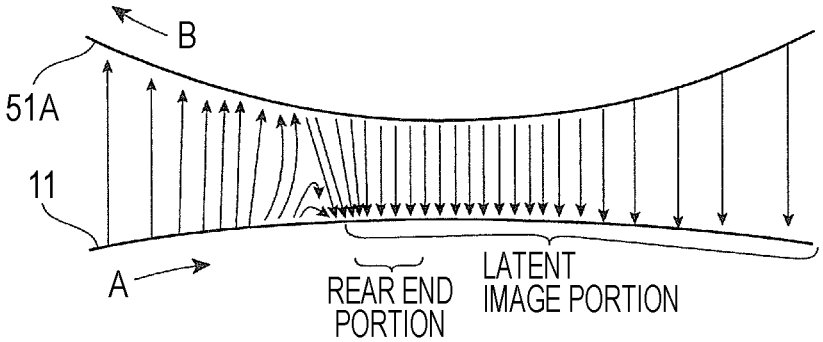
FIGS. 6A and 6B each illustrate the relationship between the size of an interval between a photoconductor drum and the developing roller (DRS), and the state of a fringe electric field.
Figure 6B:
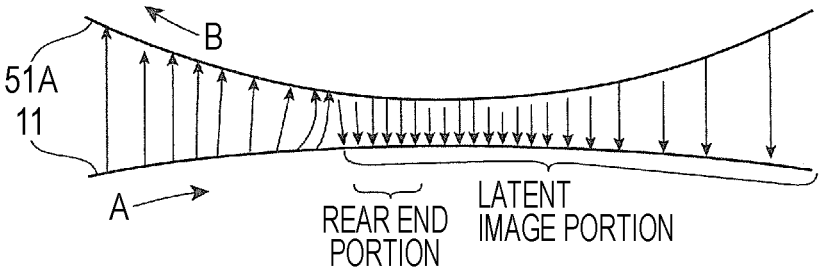
Figure 7:
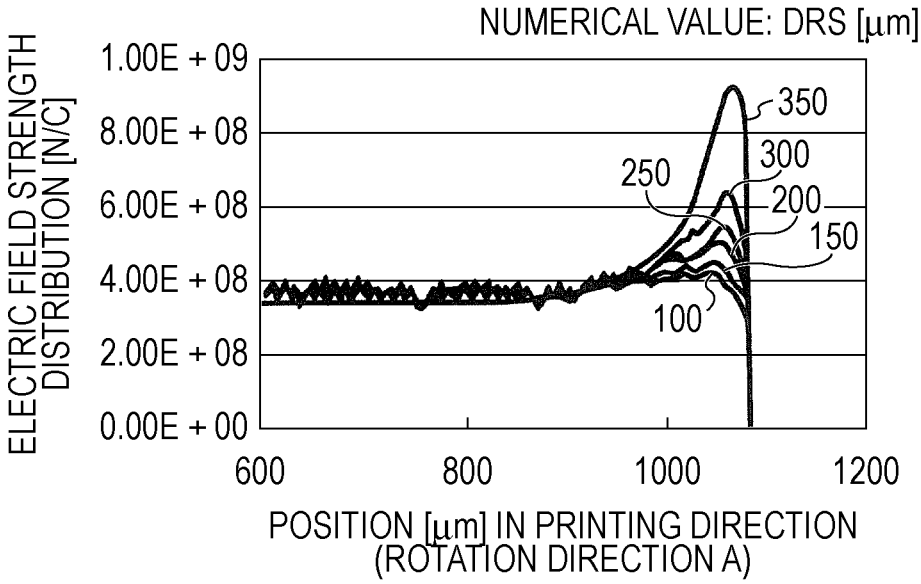
FIG. 7 is a graph showing the result of measurement of the fringe electric field when the interval (DRS) is changed.

As the distance (DRS) becomes smaller, the fringe electric field at the rear end of an image (latent image) becomes smaller as shown in FIGS. 6B and 7. Therefore, by setting the distance (DRS) as small as possible, excessive development (enhancement) at the rear end of the image caused by the fringe electric field may be suppressed, as a result of which the occurrence of rear end enhancement may be suppressed. FIG. 7 shows the results that are obtained when electric field calculation is simulated in the case where 100% halftone images (latent images) are formed under image formation conditions that are the same as those in the confirmatory test.

On the other hand, when the distance (DRS) becomes less than 125 μm, excluding the case in which the developer density at the contact region (K) of the magnetic brush becomes extremely small (that is, less than 1.0 g/m$^3$), a different trouble in which the two-component developer 8 is jammed in the gap (development gap) between the sleeve 51A and the photoconductor drum 11 occurs.

Therefore, when the distance (DRS) becomes greater than or equal to 100 μm, the occurrence of rear end enhancement of an image may be suppressed without the occurrence of jamming of the developer in the development gap.

Next, when the developer density at the region K where a magnetic brush contacts the photoconductor drum 11 is less than or equal to $1.5\times10^{-6}$ g/m$^3$, the occurrence of rear end enhancement may tend to be suppressed.

As the developer density becomes smaller, the action of sweeping of toner by a magnetic brush 80 is reduced because the magnetic brush 80 is not dense. Therefore, by setting the developer density as small as possible, the movement of the toner towards the back of the developed image caused by the action of sweeping of the toner by the magnetic brush may be suppressed, as a result of which the occurrence of rear end enhancement may also be suppressed.

Figure 8:
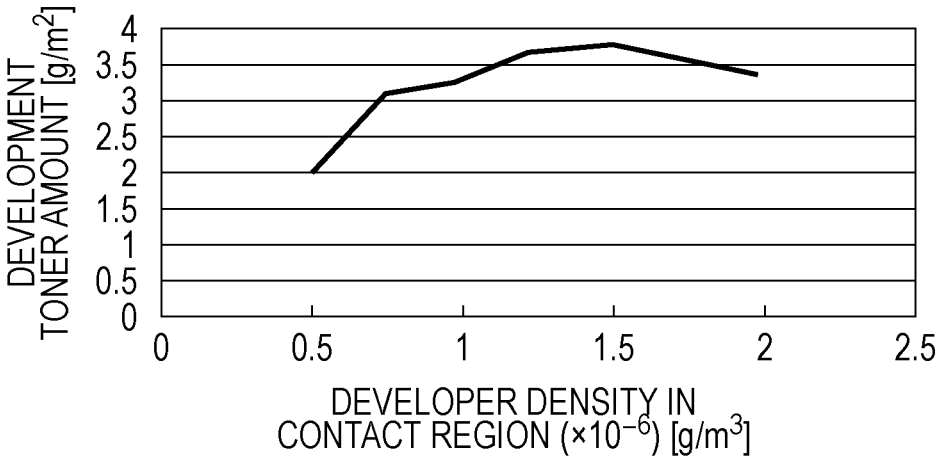
FIG. 8 is a graph showing the relationship between developer density at the contact region and the amount of development toner.

When the developer density becomes too small, the absolute amount of toner when the toner is transported on the developing roller 51 (sleeve 51A) by the magnetic brush becomes small. Therefore, as shown in FIG. 8, the amount of development toner used to develop the latent image is relatively reduced, as a result of which developability is reduced. The development toner amount with respect to each developer density in FIG. 8 is obtained by attracting toner that adheres to the photoconductor drum where the development has been performed and measuring the mass of the attracted toner, using an electronic balance measuring device (product by Mettier: AT201). The development toner amount that is greater than or equal to 3 g/m$^2$ is an allowable level, so that proper development may be performed. When the developer density becomes too high, a different trouble in which the two-component developer is jammed in the development gap occurs.

Therefore, when the developer density is within the range of from $0.75\times10^{-6}$ to $1.50\times10^{-6}$ g/m$^3$, it is possible to maintain good developability and to suppress the occurrence of rear end enhancement of an image without the occurrence of jamming of developer in the development gap.

When the width (K) of the region where a magnetic brush contacts the photoconductor drum 11 is less than or equal to 2.25 mm, the occurrence of rear end enhancement may tend to be suppressed.

As the region width (K) becomes smaller, the number of times the magnetic brush 80 contacts the electrostatic latent image at the development area is reduced. Therefore, the action of sweeping of toner by the magnetic brush is reduced. Therefore, by setting the region width (K) as small as possible, the movement of the toner towards the back of the developed image caused by the action of sweeping of the toner by the magnetic brush is suppressed, as a result of which the occurrence of rear end enhancement may also be suppressed.

In contrast, when the region width (K) is made too small, the influence resulting from the difference between the number of times each latent image is rubbed by a magnetic brush becomes large, as a result of which unevenness in the density of an image that is developed (that is, development unevenness) tends to occur. When the region width (K) becomes too large, the number of times the latent image is rubbed by the magnetic brush is increased, as a result of which the two-component developer tends to be influenced by the action of sweeping of the toner by the magnetic brush.

Consequently, when the region width (K) is within the range of from 1.0 to 2.25 mm, the occurrence of rear end enhancement of the image may be suppressed without the occurrence of development unevenness.

According to the study by the inventor et al., it is confirmed that rear end enhancement of an image in the developing device 5 (image forming apparatus 1) may be reliably suppressed when the specific gravity of toner in the two-component developer 8 is within the range of from 1.02 to 1.50, and when the specific gravity of the carriers thereof is within the range of from 4.2 to 5.0.

When the specific gravity of toner is less than 1.02, it is difficult to use, for example, acrylic resin and polyester resin as binding resin of the toner. In contrast, when the specific gravity of toner exceeds 1.50, it is difficult to use acrylic resin and polyester resin as binding resin of the toner, as a result of which it is difficult to form the toner as proper toner due to the occurrence of secondary troubles in the external additive that adheres to the toner particles of the binding resin. When the specific gravity of the carriers is less than 4.2, for example, the magnetic material (such as, ferrite material) content is reduced, as a result of which magnetic permeability becomes too low. Therefore, the magnetic carriers are not capable of performing their functions. In contrast, when the specific gravity of the carriers exceeds 5.0, it is difficult to manufacture, for example, magnetic carriers whose principal ingredient is a ferrite material.

Incidentally, when the specific gravity of the toner and the specific gravity of the carriers are less than the lower limits of their corresponding numerical ranges, the strength of a magnetic brush of the two-component developer 8 becomes weak, as a result of which the developability of a latent image is reduced. In contrast, when each specific gravity exceeds the upper limit of its corresponding numerical range, the transportability of the two-component developer 8 at the developing roller 51A is reduced, and the strength of a magnetic brush becomes too high, as a result of which the toner image that has been developed by the magnetic brush tends to crumble.

The state of occurrence of rear end enhancement of an image when the relative velocity between the developing roller 51 and the photoconductor drum 11 has been changed is checked in accordance with the test.

Figure 9:
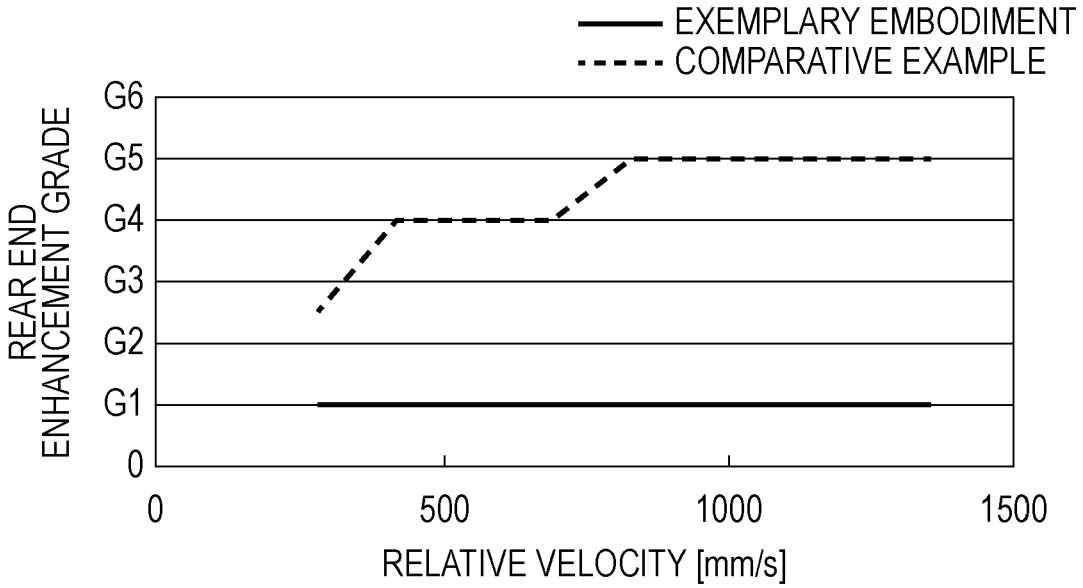
FIG. 9 is a graph showing the relationship between the relative speed between the photoconductor drum and the developing roller and the state of occurrence of rear end enhancement.

As a result, as shown in FIG. 9, in a comparative example in which the above-described structure for addressing the aforementioned problems is not used, as the relative velocity is increased, rear end enhancement of an image tends to further increase. In contrast, as shown in FIG. 9, in the exemplary embodiment in which the above-described structure for addressing the aforementioned problems is used, even if the relative velocity is increased, the occurrence of rear end enhancement of an image is suppressed, so that a low level (G1) may be maintained. By this, according to the exemplary embodiment of the invention, even if, for example, the image forming apparatus 1 (that is, the developing device 5) has a relatively high processing speed (the processing speed of a high-speed apparatus is 250 ram/sec or higher), the occurrence of rear end enhancement of the image may be suppressed even though the toner tends to be influenced by the action of sweeping by the magnetic brush as the relative velocity increases.

Here, in the comparative example, DRS=300 μm, the contact region width K=3.5 mm, and the developer density at the contact region=$1.25\times10^{-6}$ g/m$^3$. In contrast, in the exemplary embodiment, DRS=150 μm, the contact region width K=1.25 mm, and the developer density at the contact region=$1.25\times10^{-6}$ g/m$^3$. Here, with the rotation velocity of the photoconductor drum 11 being maintained at 350 mm/sec, the rotation speed of the developing roller 51 (sleeve 51A) is gradually increased, to change the relative velocity.

Further, the states of occurrences of rear end enhancement of an image when surface energy (water droplet contact angle) at an outermost portion of the peripheral surface of the photoconductor drum 11 are checked in accordance with the test.

Figure 10:
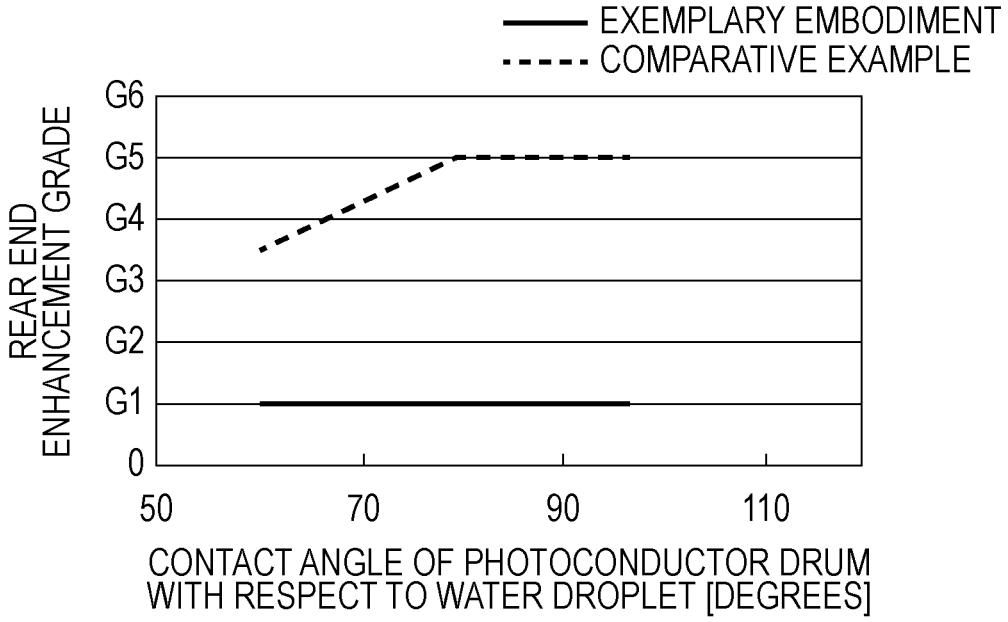
FIG. 10 is a graph showing the relationship between the angle of contact of a water droplet with respect to the photoconductor drum and the state of occurrence of rear end enhancement.

As shown in FIG. 10, the result is that, in a comparative example in which the above-described structure for addressing the aforementioned problems is not used, rear end enhancement of an image tends to further increase as the surface energy at the photoconductor drum is reduced, whereas, in the exemplary embodiment in which the above-described structure for addressing the aforementioned problems is used, even if the surface energy at the photoconductor drum is reduced, the occurrence of rear end enhancement at the image may be suppressed, as a result of which a low level (grade G1) may be maintained. By this, according to the exemplary embodiment, even if the image forming apparatus 1 includes, for example, the photoconductor drum 11 including an outermost surface layer (overcoat layer), formed of phenol resin, at its outermost surface, it is possible to suppress the occurrence of rear end enhancement of an image even though the toner tends to be influenced by the action of sweeping by the magnetic brush due to a reduction in the coefficient of friction with respect to the toner because of a reduction in the surface energy. The conditions of the comparative example and the exemplary embodiment here correspond to those of the previous comparative example and exemplary embodiment. The reduction in the surface energy is changed by causing, for example, zinc strearate to adhere to the peripheral surface of the photoconductor drum 11. The water droplet contact angle is obtained by placing a 0.02 ml pure-water droplet on the peripheral surface of the photoconductor drum 11, and measuring the angle of a tangent to a surface of an edge of the pure-water droplet with respect to the peripheral surface of the photoconductor drum 11 (pure-water droplet contact angle).

Other Exemplary Embodiments

The developing device 5 according to the exemplary embodiment of the invention includes one developing roller 51. However, in another exemplary embodiment, a developing device including more than one developing roller with at least one of the developing rollers using a contact counter developing system may also be used.

As long as the image forming apparatus 1 using the developing device 5 is capable of using the developing device 5 (including the two-component developer 8), for example, the type thereof is not particularly limited. The image forming apparatus may be of a type that forms a color image or a type that uses an intermediate transfer system.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A two-component developer comprising:

toner; and a magnetic carrier, wherein the two-component developer is used in a developing device including a circular cylindrical developer transporting member that is disposed so as to be separated by 125 μm to 250 μm from a latent image carrier that rotates, the developer transporting member rotating so that a direction of movement of a portion thereof that approaches the latent image carrier is in an opposite direction, the two-component developer is carried and transported by the developer transporting member of the developing device while a magnetic brush is formed, and the two-component developer is used so as to satisfy a condition in which a width of a region where the magnetic brush contacts a surface of the latent image carrier is in a range of from 1.0 mm to 2.25 mm, and a condition in which a developer density of the region where the magnetic brush contacts the surface of the latent image carrier is in a range of from $0.75\times10^{-6}$ to $1.50\times10^{-6}$ g/m$^3$.

2. A developing device comprising:

a circular cylindrical developer transporting member that rotates so that a direction of movement of a portion thereof that approaches a latent image carrier that rotates is in an opposite direction, the developer transporting member carrying and transporting a two-component developer while a magnetic brush is formed, the two-component developer including toner and a magnetic carrier, wherein the developing device is used in states in which a distance between the developer transporting member and the latent image carrier is in a range of from 125 μm to 250 μm, a width of a region where the magnetic brush that is formed at the developer transporting member contacts a surface of the latent image carrier is in a range of from 1.0 mm to 2.25 mm, and a developer density of the region where the magnetic brush that is formed at the developer transporting member contacts the surface of the latent image carrier is in a range of from $0.75\times10^{-6}$ to $1.50\times10^{-6}$ g/m$^3$.

3. An image forming apparatus comprising:

a latent image carrier that rotates; and a developing device that includes a circular cylindrical developer transporting member that rotates so that a direction of movement of a portion of the developer transporting member that approaches the latent image carrier is in an opposite direction, the developer transporting member carrying and transporting a two-component developer while a magnetic brush is formed, the two-component developer including toner and a magnetic carrier, wherein a distance between the developer transporting member and the latent image carrier is in a range of from 125 μm to 250 μm, a width of a region where the magnetic brush that is formed at the developer transporting member contacts a surface of the latent image carrier is in a range of from 1.0 mm to 2.25 mm, and a developer density of the region where the magnetic brush that is formed at the developer transporting member contacts the surface of the latent image carrier is in a range of from $0.75\times10^{-6}$ to $1.50\times10^{-6}$ g/m$^3$.

* * * * *